US008991088B1

(12) United States Patent
Young

(10) Patent No.: US 8,991,088 B1
(45) Date of Patent: Mar. 31, 2015

(54) FOLDING BUTTSTOCK FOR FIREARMS WITH RECOIL ASSEMBLIES CONTAINED WITHIN THE BUTTSTOCK

(71) Applicant: Hunter Young, Troutville, VA (US)

(72) Inventor: Hunter Young, Troutville, VA (US)

(73) Assignee: CQ Innovations, Inc., Troutville, VA (US)

( * ) Notice: Subject to any disclaimer, the term of this patent is extended or adjusted under 35 U.S.C. 154(b) by 18 days.

(21) Appl. No.: 13/680,308

(22) Filed: Nov. 19, 2012

Related U.S. Application Data

(60) Provisional application No. 61/561,249, filed on Nov. 17, 2011.

(51) Int. Cl.
*F41C 23/04* (2006.01)
*F41A 25/00* (2006.01)

(52) U.S. Cl.
CPC ..... *F41A 25/00* (2013.01); *F41C 23/04* (2013.01)
USPC ..... 42/75.03

(58) Field of Classification Search
CPC ..... F41C 23/14; F41C 23/04
USPC ..... 42/75.03, 72, 71.01, 75.01, 73; 89/158
See application file for complete search history.

(56) References Cited

U.S. PATENT DOCUMENTS

| | | | | |
|---|---|---|---|---|
| 6,591,533 | B2 | 7/2003 | Wygant | |
| 7,673,412 | B2 | 3/2010 | Griffin | |
| 7,802,392 | B2 | 9/2010 | Peterson et al. | |
| 2006/0242880 | A1 | 11/2006 | Griffin | |
| 2010/0212206 | A1 | 8/2010 | Griffin | |
| 2010/0307042 | A1 | 12/2010 | Jarbee et al. | |
| 2011/0131857 | A1* | 6/2011 | Kuczynko et al. | 42/73 |
| 2013/0212920 | A1* | 8/2013 | Law | 42/75.03 |

FOREIGN PATENT DOCUMENTS

| | | |
|---|---|---|
| EP | 1026472 | 1/2000 |

* cited by examiner

*Primary Examiner* — Samir Abdosh
*Assistant Examiner* — John D Cooper
(74) *Attorney, Agent, or Firm* — Rhodes IP PLC; Christopher R Rhodes

(57) ABSTRACT

An innovative design described in this application retains the buffer and recoil spring within the folded portion of the buttstock or buffer tube so the stock can fold. There are alternative ways to retain the buffer and recoil spring within a folded buttstock. The bolt carrier is not physically attached to the buffer and recoil spring. A folding stock assembly which contains the buffer and buffer spring within the folded portion of the stock for a firearm that uses a direct gas impingement system.

24 Claims, 10 Drawing Sheets

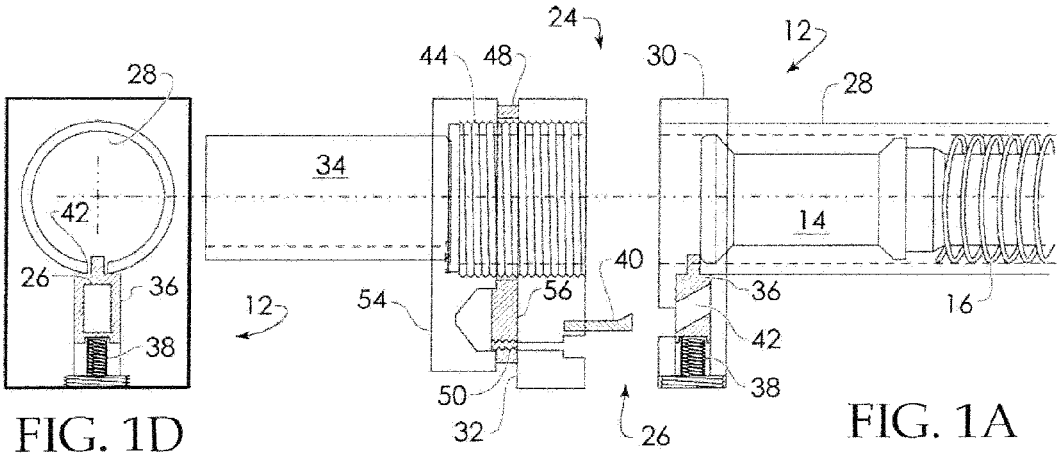
FIG. 1D
FIG. 1A
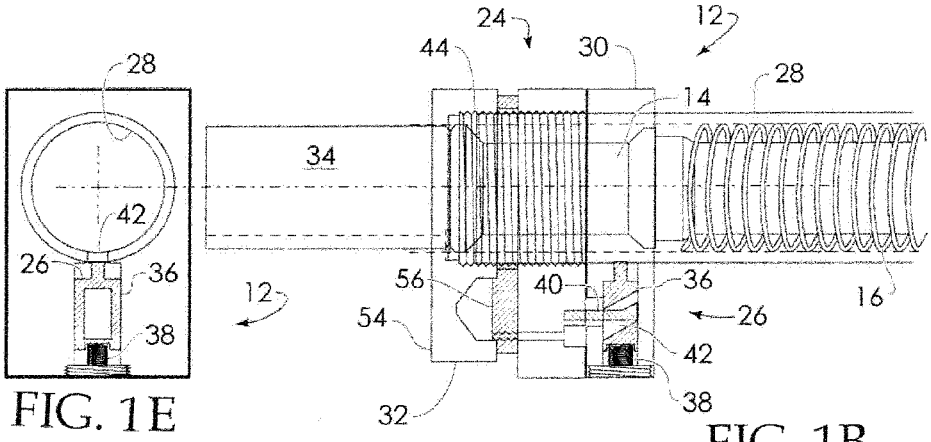
FIG. 1E
FIG. 1B
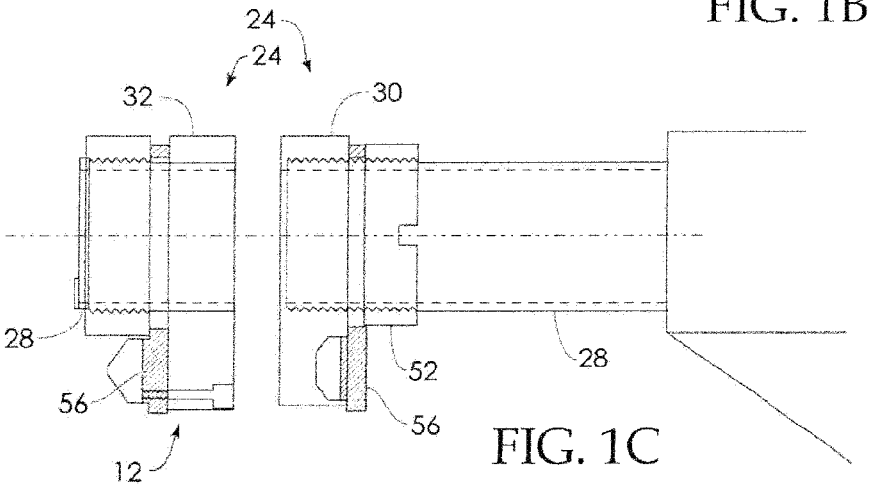
FIG. 1C

FOLDING BUTTSTOCK FOR FIREARMS WITH RECOIL ASSEMBLIES CONTAINED WITHIN THE BUTTSTOCK

RELATED APPLICATIONS

This application claims the benefit of U.S. Provisional Application Ser. No. 61/561,249 entitled "FOLDING BUTTSTOCK FOR FIREARMS WITH RECOIL ASSEMBLIES CONTAINED WITHIN THE BUTTSTOCK" filed on 17 Nov. 2011.

BACKGROUND OF THE INVENTION

Compactly storing a firearm is a challenge. This is especially the case for firearms such as M-16/AR-15/AR-10 types which have mechanisms that use direct gas impingement. Many M-16 type weapons have a direct gas impingement system, and could benefit from being able to fold the stock; however, suitable mechanisms permitting a folding stock in a direct gas impingement system have not been developed.

Folding stocks are known. US Patent Application No. 2010/0307042 shows a modular firearm stock system which includes a foldable butt stock assembly. U.S. Pat. No. 7,966,761 shows an automatic or semiautomatic rifle with a folding stock. Similarly, US Patent Application No. 2011/0131857 shows an automatic or semiautomatic rifle with a folding stock which is the same as in U.S. Pat. No. 7,966,761. U.S. D636,834 shows simply a folding firearm stock without internal details. US Patent Application No. 2010/0212206, and U.S. Pat. Nos. 7,827,721 and 7,673,412 show folding stock assemblies that do not accommodate any mechanisms. U.S. Pat. No. 7,418,797 shows another simple foldable rifle stock which has an added adjustable cheek pad. These foldable butt stock assemblies simply function as foldable stocks and do not accommodate any actuation.

Firearms which incorporate hinges are also known. U.S. Pat. No. 7,802,392 teaches tactical firearm systems, and methods of manufacturing same, which includes a modular locking hinge having two parts that attach modular components; however, the hinge does not appear to be used for a foldable stock. U.S. Pat. No. 6,591,533 shows a locking hinge used with a folding shoulder rest for a paintball gun which basically is analogous to a rifle stock for a handgun.

Direct gas impingement systems in M-16 type weapons bleed combustion gas from the barrel and convey it through a hollow tube back to the weapon's upper receiver. The gas from the tube pushes rearward on the bolt carrier assembly that rides within the upper receiver. The rearward push on the bolt carrier assembly, and attached bolt, cause the assembly to move rearward. The rear of the bolt carrier assembly bears against a recoil buffer and associated spring which are contained within the buffer tube, buttstock, or a receiver extension. When the bolt travels rearward, it compresses the buffer spring; it is this force combined with the weight of the buffer which slows, and then stops, the bolt carrier assembly's rearward movement. The direction of movement then reverses, and the carrier assembly travels forward again, back into battery.

SUMMARY OF THE INVENTION

The present invention is a folding buttstock for firearms with recoil assemblies contained within the buttstock or equivalent. The buffer and recoil spring are retained within a buffer tube of the buttstock so the stock can fold. The innovation provides a device that bisects the buffer tube by providing a hinge therebetween. In operation, the buffer and buffer spring may be retained within the buttstock when the buttstock is folded back. The bolt carrier is not physically attached to the buffer and recoil spring, but instead, the bolt carrier and buffer spring merely bear against each other. The present invention is described by way of a buttstock with a shoulder rest; however, weapons that only have a rearward extending buffer tube without the shoulder rest are included.

Folding stocks are desirable on firearms because they make them easier to store and transport. There are no folding stocks available for conventional M-16 style rifles and pistols which utilize direct gas impingement. The present design retains the buffer and spring within the folded stock, and makes it possible to have an M-16 style rifle with a folding stock. A folding stock assembly which contains the buffer and buffer spring within the folded portion of the stock for a firearm that uses a direct gas impingement system.

To actuate the bolt carrier assembly and related appurtenances, in this style of firearm, there is a recoil buffer (weighted cylinder) and spring which are contained within a buffer tube. The buffer tube forms part of such weapon's buttstock, and extends therefrom towards the muzzle end of the weapon. The buffer travels within the buffer tube in response to the recoil of the weapon upon firing.

A manually operated hinge release mechanism may be used to both allow hinge movement operation and to activate or actuate the system which retains the buffer within the butt stock. Additionally, these two operations could utilize separate controls whereby one controls the hinge opening/closing and the other controls the mechanism used to retain the buffer/spring within the buttstock. A manually operated mechanism is utilized to lock the buffer tube hinge closed, or straight, position so that the weapon may be operated. Further, retainer devices may be utilized to hold the buffer tube in an open, or folded, position.

These and other aspects of the present invention will become readily apparent upon further review of the following drawings and specification.

BRIEF DESCRIPTION OF THE DRAWINGS

The novel features of the described embodiments are specifically set forth in the appended claims; however, embodiments relating to the structure and process of making the present invention, may best be understood with reference to the following description and accompanying drawings.

FIG. 1A shows a side view of an alternative embodiment of the current design with the buffer retained in the buttstock buffer tube.

FIG. 1B shows a side view of an alternative embodiment of the current design with the buffer free to move into the forward buffer tube.

FIG. 1C shows a side view of folding buttstock according to alternative embodiment of the current design.

FIG. 1D shows a front view of the retainer mechanism in position to retain the buttstock buffer tube.

FIG. 1E shows a front view of the retainer mechanism in position to permit the buffer and spring to move into the forward buffer tube.

Similar reference characters denote corresponding features consistently throughout the attached drawings.

DETAILED DESCRIPTION OF PREFERRED EMBODIMENTS

Figure 2:
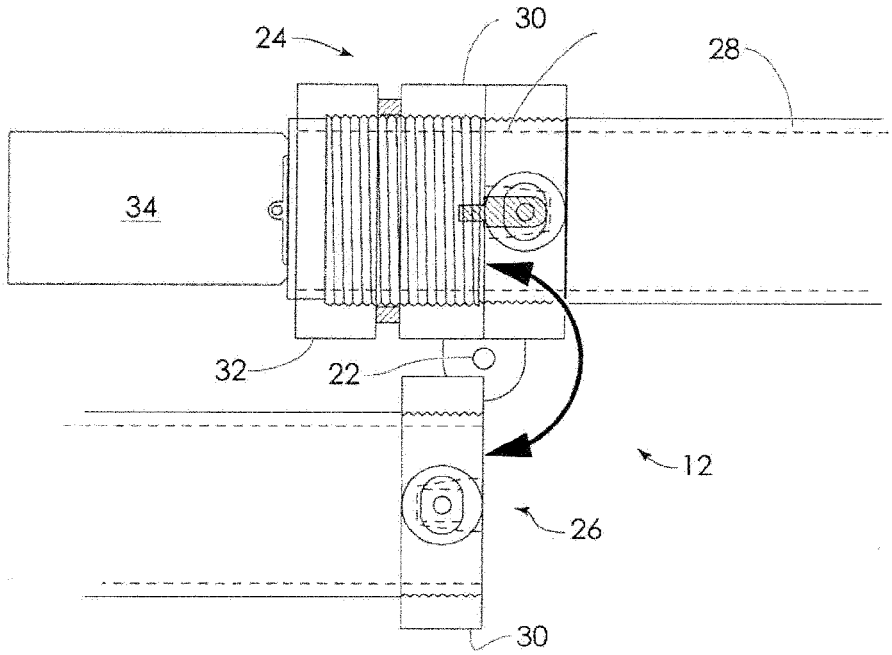
FIG. 2 is a top view of the embodiment shown in FIGS. 1A and 1B, which demonstrates the hinged attachment.

A folding stock assembly 12 contains a buffer tube folding mechanism 24, an embodiment of which is shown in FIGS. 1A, 1B and 1C, with a buffer 14 and a buffer spring 16 disposed within a buffer tube 28 within the folded portion of the stock 18 for a firearm 20 that uses a direct gas impingement system. A buffer tube folding mechanism 24 is provided which has first and second collars 30 and 32, hingedly attached to one another, with openings therethrough. A buffer retainer 26 is shown if FIGS. 1D and 1E to retain the buffer 14 therein. FIG. 1A in greater detail shows, a buffer tube 28 of a buttstock 18 is attached to the rear hinge block, which is the first collar 30. The buffer retainer 26, shown in FIGS. 1A, 1B, 1D, and 1E, has a plunger 36 is contained in the collar 30 just below the opening therethrough, and the plunger 36 is pushed upward by plunger spring 38 when the collars 30 and 32 are not closed. The plunger 36 protrudes into opening of the collar 30 and prevents the buffer 14 and spring 16 from falling out.

When the collars 30 and 32 are closed for use as shown in FIG. 1B, the retainer actuator 40 engages plunger 36 and pushes it downward due to the angled opening 42 in the plunger 36. Actuator 40 may have a roller tip or other means of reducing friction (not shown) when it contacts plunger 36. Plunger 36 may also have bearings where it is engaged by actuator 40. Additionally, the plunger 36 may have bearings on its exterior to reduce the friction when it moved up/down within its opening. The opening 42 through which plunger 36 moves may also have bearings.

The first collar 30 is shown in FIGS. 1A and 1B as threading into a first receiver 44. A modified standard lock ring 48 is shown with a hole threaded through 50 to accept a screw (not shown for clarity) which will prevent the first collar 30 from rotating. There are many other possible methods for preventing the collars 30 and 32 from rotating.

FIG. 1C shows that the first collar 30 may have a standard buffer tube 28 of buttstock 18 installed using the conventional lock ring 48 with a castle nut 52. Other methods would also work and these elements have generally been omitted from the other figures for the sake of clarity. Additionally, the first collar 30 may be connected to the lower receiver 54 in several different ways. The second collar 32 may contain an integral threaded tube which would screw into the lower receiver in the same manner as a standard buffer tube 28 or it may utilize a separate threaded tube which would thread into both the lower receiver 54 and the second collar 32. If necessary to help the threads index such that the second collar 32 aligns properly with the lower receiver 54, then a spacer or spacers of variable thickness could be used in place of or to augment a lock ring 56.

FIG. 2 is essentially a top view of the elements shown in FIGS. 1A and 1B, except that it also shows a hinge 22. The elements are shown in both their folded and unfolded positions. A weapon 20 has a folding stock assembly 12 with a buffer 14 and a buffer spring 16 retainable within the folded buttstock 18. The buttstock 18 folds laterally on hinges 22, as demonstrated in FIG. 2, connected on the side thereof.

Figure 3A:
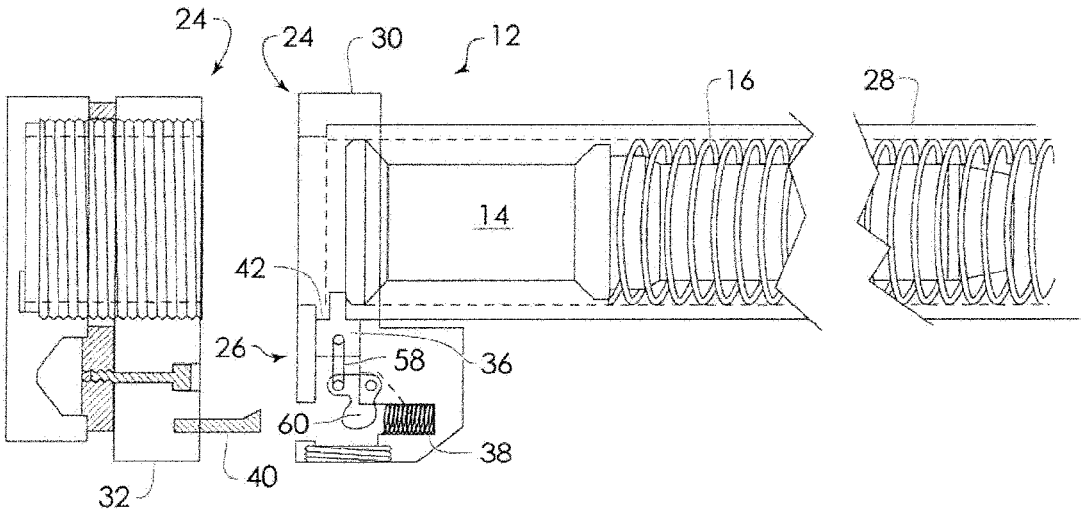
FIG. 3A shows a partially exploded side view of an alternative embodiment of the current design with the buffer retained in the buttstock buffer tube.
Figure 3B:
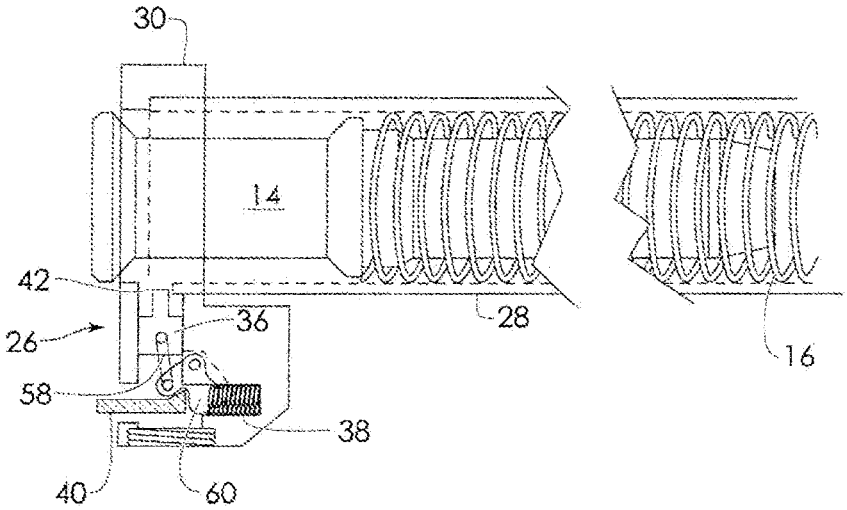
FIG. 3B show side views of an alternative embodiment of the current design with the buffer and buffer spring unrestrained.

The innovative design described in this application retains the buffer 14 and recoil spring 16 within the folded buttstock 18 in the first collar 30 on the buffer tube 28 of the buttstock 18. There are alternative ways to retain the buffer 14 and recoil spring 16 within a folded buttstock 18, each blocking the opening at the first collar 30 retaining the buffer 14. FIGS. 3A and 3B show an alternative retainer mechanism 26 that is biased upwards to block the motion of the buffer 14. The retainer mechanism 26 is actuated by closing the collars 30 and 32 whereupon the retainer 26 is withdrawn permitting unhindered movement of the buffer 14 and spring 16. FIG. 3A shows a different arrangement to actuate the plunger 36 which utilizes a connecting rod 58 and a bellcrank 60. When the stock 18 is folded to the side, the bellcrank spring 38 moves within the recess shown, and pushes the connecting rod 58 and plunger 36 upward. This retains buffer 14 and spring 16 within the buffer tube 28 of the buttstock 16. FIG. 3B shows that when the stock is unfolded to the rear, the actuator 40 presses on the bellcrank 60 which causes it to pivot as shown. This puts tension on connecting rod 58 and pulls plunger 36 downward, thereby allowing the buffer 14 and buffer spring 16 to move unhindered to bear against the bolt carrier assembly (not shown).

Note that all the previous figures show a protrusion from the plunger 36 at the six o'clock position into the buffer tube 28 of the buttstock 18 which retains the buffer 14 and spring 16 when the stock 18 is folded. Note that there is a recess in the conventional bolt carrier assembly 34 which allows the bolt carrier assembly 34 to pass over the protrusion and into the buffer tube 28 of the buttstock 18. The buffer 14 does not have such a recess and therefore cannot pass over the buffer retainer 26.

Figure 4A:
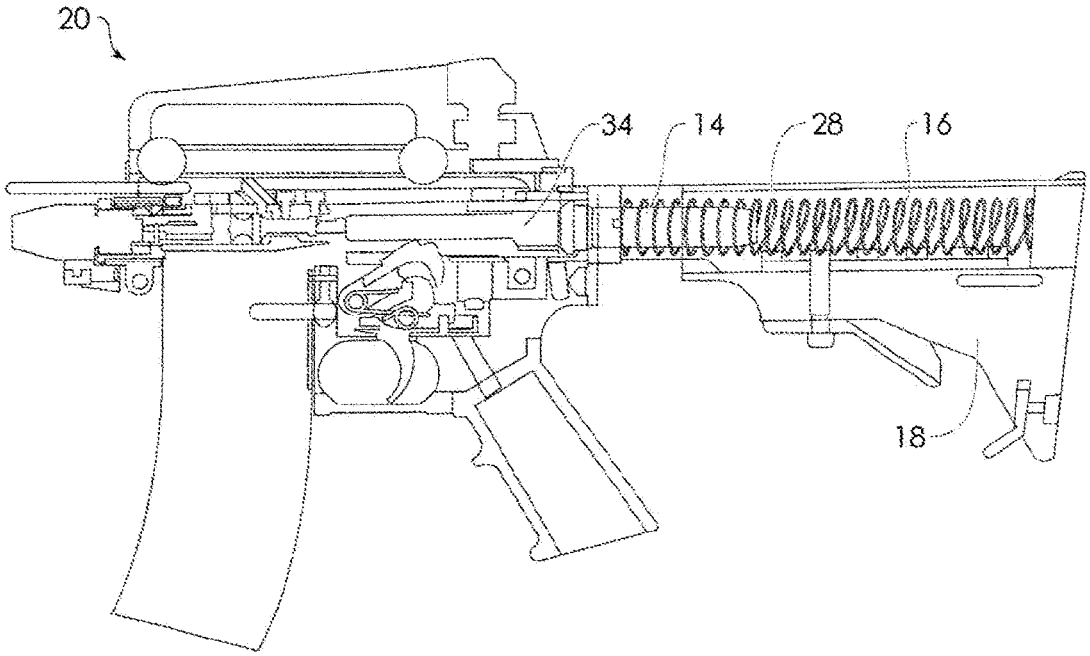
FIG. 4A PRIOR ART
FIG. 4A shows a side view of the prior art weapon having a buttstock with the buffer and buffer spring forward.
Figure 4B:
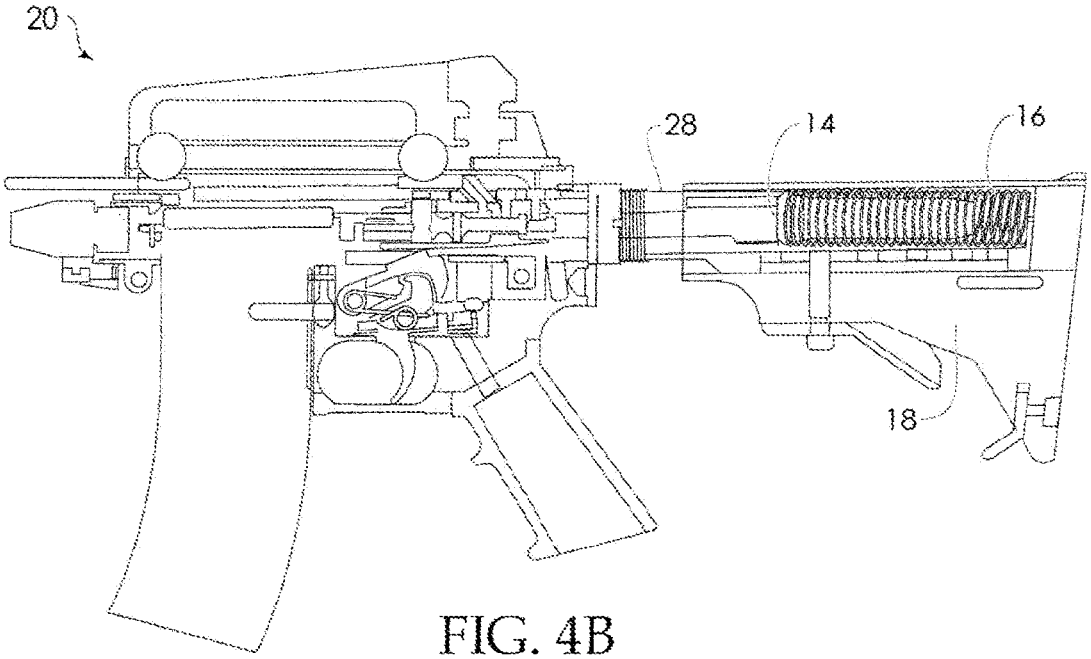
FIG. 4B PRIOR ART
FIG. 4B shows a side view of the prior art weapon having a buttstock with the buffer and buffer spring backwards into the buttstock.

Conventional wisdom had deemed it impossible for known M-16 style weapons which are shown in FIGS. 4A and 4B to have a folding buttstock 18. The various embodiments of the present design work because the bolt carrier 34 is not physically attached to the buffer 14 and recoil spring 16. Instead, the bolt carrier 34 and buffer spring 16 merely bear against each other. When the weapon 20 discharges and the bolt carrier mechanism 34 is actuated, it is pushed partially into the buffer tube 28 of the buttstock 18 thereby forcing the buffer 14 rearward and compressing the buffer spring 16. After the spring 16 stops the rearward motion of the buffer 14 and bolt carrier assembly 34, it forces them forward and reloads the weapon 20.

The design of the present invention system is applicable to other weapons beyond the M-16 family of firearms, and is not limited to those style weapons. Indeed, any weapon which contains part of its operating mechanism within the buttstock could potentially benefit from the present design. When the stock 18 is folded, the bolt carrier 34 may still travel rearward and protrude from the weapon 20, but is prevented from falling out by the charging handle and lower receiver.

The same methods which are used to retain the buffer 14 and spring 16 assembly within the buttstock 18 are adapted to retain the bolt carrier 34 deeper within the weapon's receiver and prevent much of its rearward movement. This may be accomplished automatically upon folding/unfolding the stock 18 or with some assistance from the user. Another approach to retaining the bolt carrier 34 assembly deeper within the receiver is to pull the trigger after the stock is folded open after ensuring that the weapon is unloaded. This would allow the hammer to pivot forward and retain the bolt carrier assembly 34 completely forward within the upper receiver.

Yet another approach to retaining the bolt carrier assembly 34 deeper within the receiver is a simple plug made from plastic, rubber or a similar material. It could be easily inserted by the user and removed before the stock is unfolded. A variation of this would be two plugs which could be joined together by a string, rubber band, or similar material. One would fit into the receiver as described above and the other would fit into the first collar 30 in folded buttstock 18. These would also serve to keep dirt and other contaminants out of the operating mechanisms.

In operation, the user retracts the charging handle to move the carrier and buffer rearward while compressing the buffer spring 16. Once the buffer 14 has been moved rearward so that it is within the first collar 30, also called the rear hinge block 30 in the examples, the hinge 22 would be opened and the retainer 26 would rise to retain the buffer 14 within the buttstock 18. The stock 18 is then completely folded and the user gives a slight push forward to the bolt carrier assembly 34. Alternatively, the user could push the built-in forward assist on the upper receiver, as is well known.

Unfolding the stock 18 simply entails the user closing the hinge 22. The internal workings of the design can be timed to retract the retainer mechanism 26 and release the buffer 14 and spring 16 assembly to move forward once the buttstock 18 was adequately closed. Alternately, the retainer mechanism 26 for the buffer 14 and spring 16 could be made to require a specific manual input from the user other than simply closing the stock 18.

Figure 5A:
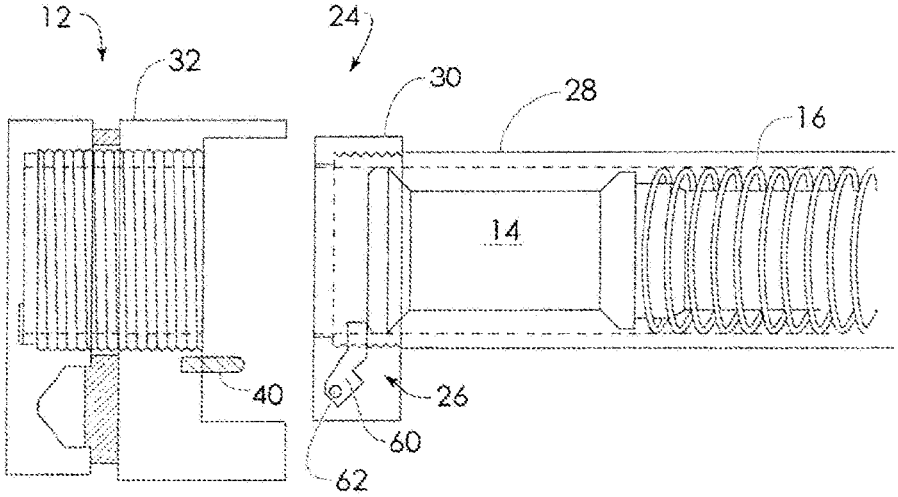
FIG. 5A shows a side view of an alternative embodiment of the current design with the buffer retained in the buttstock buffer tube.
Figure 5B:
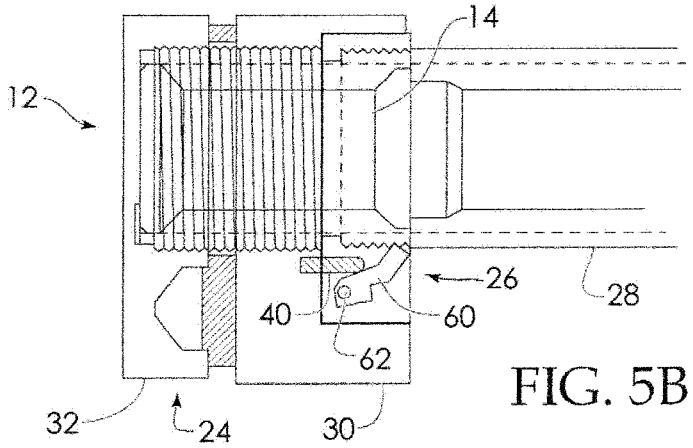
FIG. 5B shows a side view of an alternative embodiment of the current design with the buffer and buffer spring unrestrained.

The stock shown in the drawings folds to the left side, but the design is applicable to all directions including the right (ejection port) side, over the top, or under toward the magazine. A lower receiver which incorporates the elements necessary to allow an integral folding stock mechanism may also be used. The design would allow the use of existing AR-15 stocks or buffer tubes, but other designs could be created. The hinge blocks and mechanism could cause a slight increase in the distance between the rear of the bolt carrier assembly when it is battery and the inside rear of the buttstock or buffer tube. This would create less pre-load on the buffer spring and could affect the weapon's functionality. To offset this distance, a spacer could be added to the rear of the buffer spring. Alternately, the spacer could be located on the buffer itself. A longer buffer spring or one with a modified spring rate could also be created to perform the same function, as could a modified buffer. A shorter butt stock or buffer tube would serve the same purpose. The design could incorporate a safety mechanism that would prevent the weapon from discharging if the stock is folded FIGS. 5A through 5B show an embodiment of a hinge and retainer mechanism according to an alternative embodiment of the current design. FIGS. 5A and 5B show another embodiment which utilizes an arm 60 which rotates forward and rearward. When the stock 18 is folded to the side as in FIG. 2, the arm 60 is held in the forward position by a torsion spring 62. A compression spring similar to 38 in FIGS. 1A, 1B, 1D, 1E, 3A, and 3B could also be used. When the stock 18 is unfolded to the rear, the actuator 40 rotates arm 60 rearward and releases the buffer 14 and spring 16.

FIGS. 5A and 5B also show a different folding mechanism 24. In this configuration, the second collar 32 overlaps the first collar 30 when the stock 18 is unfolded. This may add rigidity to the system and may also keep foreign material out of the system. This configuration could be applied to the other embodiments as well.

Figure 6A:
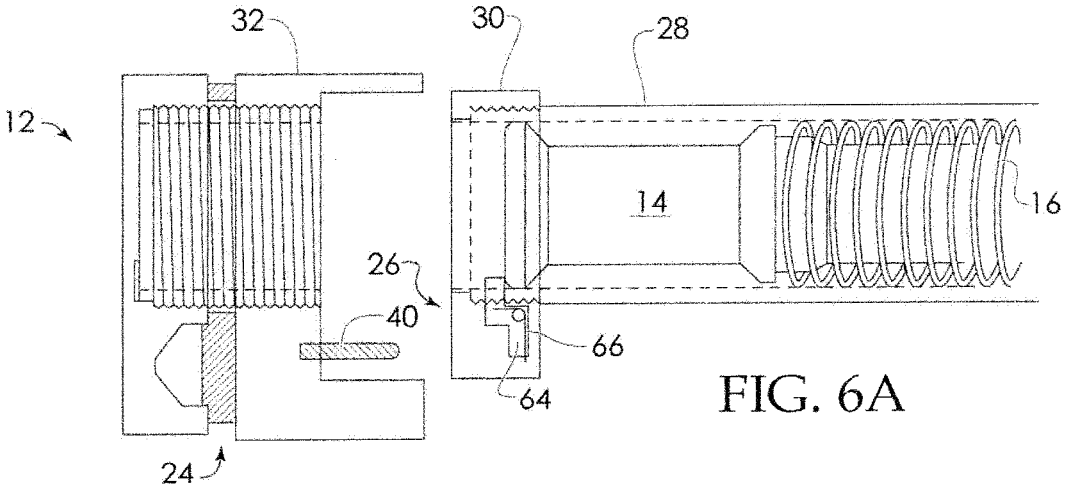
FIG. 6A shows a side view of an alternative embodiment of the current design with the buffer retained in the buttstock buffer tube.
Figure 6B:
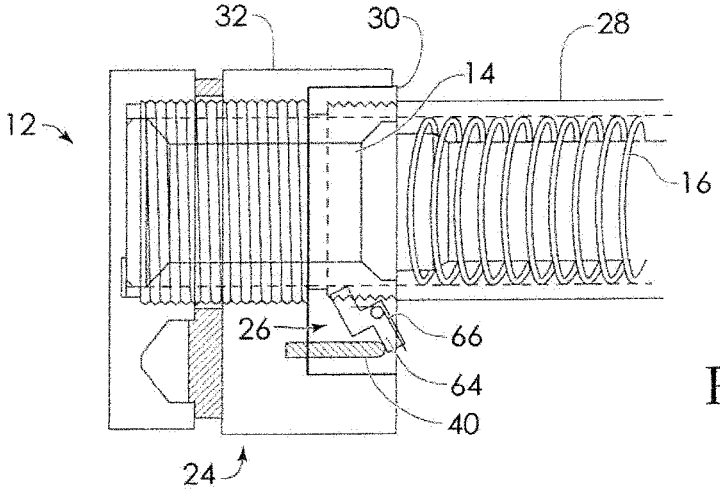
FIG. 6B shows a side view of an alternative embodiment of the current design with the buffer and buffer spring unrestrained.

FIGS. 6A through 6C show an embodiment of a hinge and retainer mechanism according to an alternative embodiment of the current design. This embodiment utilizes an arm 64 which rotates forward and rearward. When the stock 18 is folded as in FIG. 2, the arm 64 is held in the forward position by a torsion spring 66 which must be strong enough to overcome the forward force exerted by the buffer spring 16. A compression spring 38 similar as used elsewhere could also be used instead of the torsion spring 66 and other spring types may also work satisfactorily, as is well known. When the stock 18 is unfolded to the rear as in FIG. 6B, the actuator 40 rotates arm 64 rearward and releases the buffer 14.

Figure 7A:
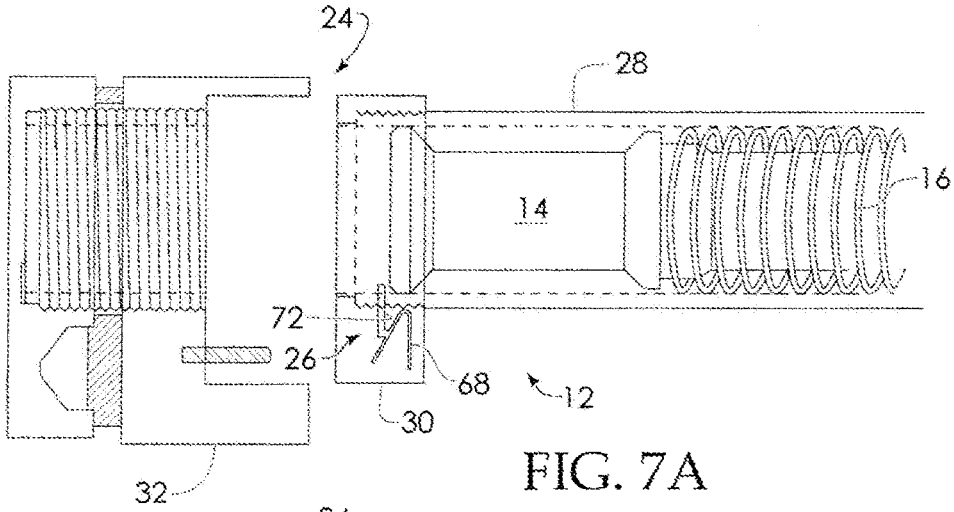
FIG. 7A shows an alternative design of a retainer mechanism using a pivot pin in which the buffer is retained in the buttstock buffer tube.
Figure 7B:
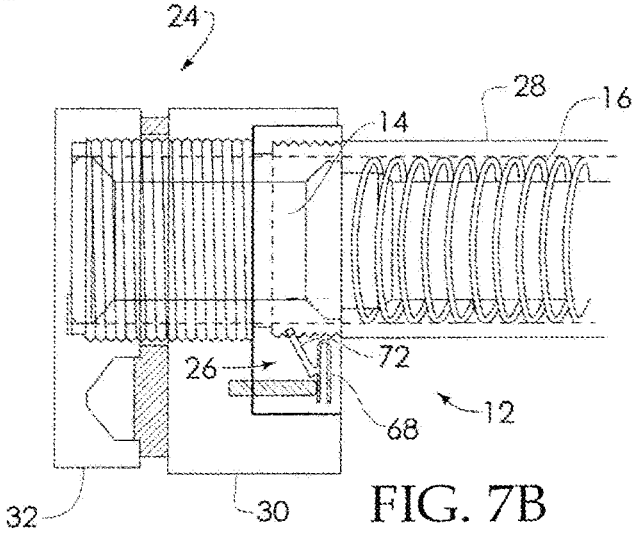
FIG. 7B show an alternative design of retainer mechanism using a pivot pin in which the buffer and buffer spring are unrestrained.

FIGS. 7A and 7B shows an alternative design of retainer mechanism 26 using a v-spring 68 with a tip 72 attached thereto, although a flat spring or leaf spring would suffice. When the stock 18 is folded to the side, the v-spring 68 expands and its tip protrudes into the first collar 30 of the buffer tube 28 which retains the buffer 14 and spring 16. When the stock 18 is unfolded for use, the actuator 40 on the second collar 32 compresses the spring. The v-spring 68 must be strong enough to overcome the forward force exerted by the buffer spring 16.

Figure 8:
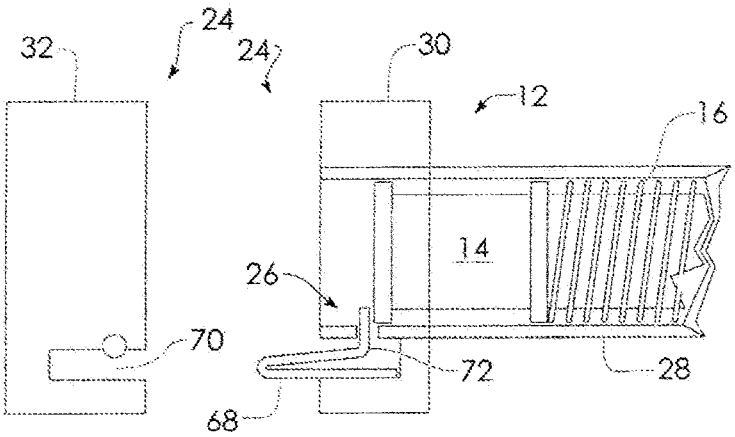
FIG. 8 shows an alternative design of retainer mechanism using v-spring in which the buffer is retained in the buttstock buffer tube.
Figure 9A:
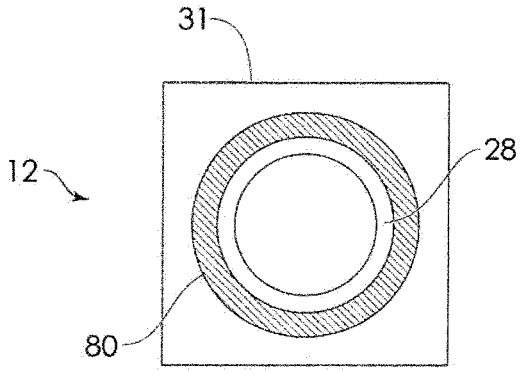
FIG. 9A through 9F show alternative designs of mechanism used to mate the collars to the buffer tubes.
Figure 9B:
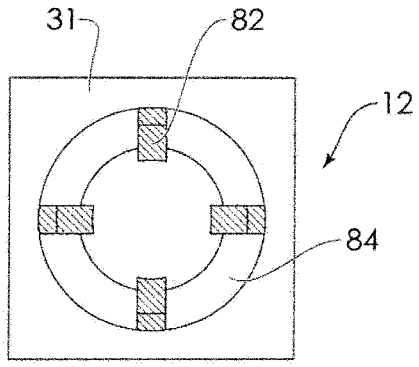
Figure 9C:
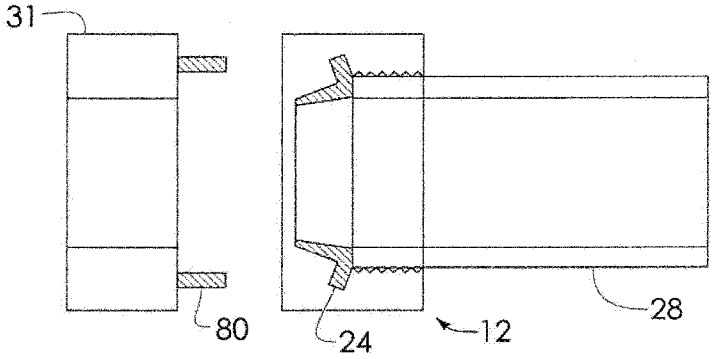
Figure 9D:
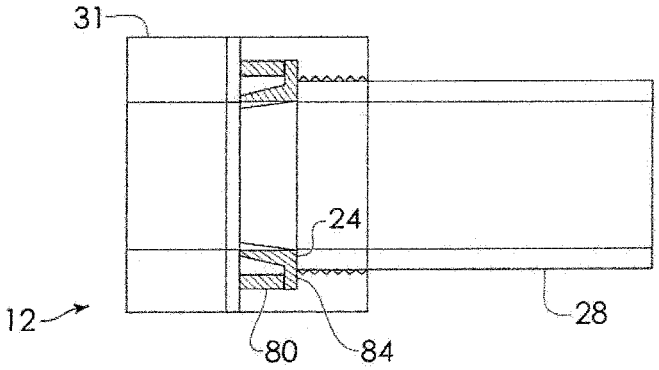
Figure 9E:
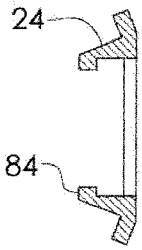
Figure 9F:
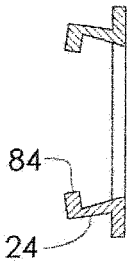

Pivot pins, torsion springs, leaf springs, tension springs, and compression springs are also usable according to various embodiments of the present design, and all are designated by the numeral 68 hereafter. FIG. 8 shows an alternative design of retainer mechanism using a pivot pin. FIG. 8 shows an embodiment that utilizes a v-spring 68 with a tip 72 which protrudes into the first collar 30 adjacent the buffer tube 28 when the stock 18 is folded. When the stock 18 is unfolded to the rear, the v-spring 68 is compressed by the opening and notch 70 in the second collar 32 which lowers the tip 72 and releases the buffer 14 and spring 16. A roller or ball bearing 74 as well as other types of bearings may be used to reduce the friction between the v-spring 68 and the notched opening 70. Additionally, the v-spring 68 may be depressed by an actuator 40 protruding from the first collar 30, as shown in FIGS. 7A and 7B, instead of an opening and notch 70 within the second collar 32. When the stock 18 is unfolded for use, the opening 70 on the second collar 32 is configured to pinch the spring 68 which retracts the tip 72 from within the first collar 30 adjacent the buffer tube 28 allowing the buffer 14 and spring 16 to move forward to meet the carrier 34.

FIGS. 9A through 9F show an alternative design of a collar 31 (either the first collar 30 or the second collar 32) to mate with the adjacent parts of the buffer tube 28 to form a single buffer tube 28 with the folding mechanism 24 when unfolded. When the stock 18 is folded, the collet release ring 80 is not in contact with the collet fingers 82. The collet fingers 82 which are attached to a collet ring 84 are springy and their normal state is contracted such that they protrude into the open interior diameter of the buffer tube 28. This effectively reduces the diameter and prevents the buffer/spring (not shown) from moving forward and exiting the first collar 30. When the buttstock 18 is unfolded, the collet release ring 80 puts pressure on the collet fingers 82 and flexes them outward, away from the inner diameter of the buffer tube 28. This increases the effective diameter and allows the buffer and spring assembly (not shown) to move forward. Note that four collet fingers 82 are shown, but more or fewer could also be used. Additionally, the collet fingers 82 could have tips 84 which would protrude and create a shoulder which would offer more positive retention of the buffer/spring.

Closer details of the hinge and retainer mechanisms are depicted throughout for reference only; numerous alternative designs of hinges are well known. FIGS. 10A through 10E show a hinge mechanism 22 for a folding buffer tube 28 according to alternative embodiments of the present design. The mechanism 22 may be adapted to accommodate either a folding buttstock 18 which retains part of the firearm's operating system within the buttstock 18, or it may accommodate a folding buttstock 18 that does not retain any of the firearm's 20 operating system within the buttstock 18.

Figure 10A:
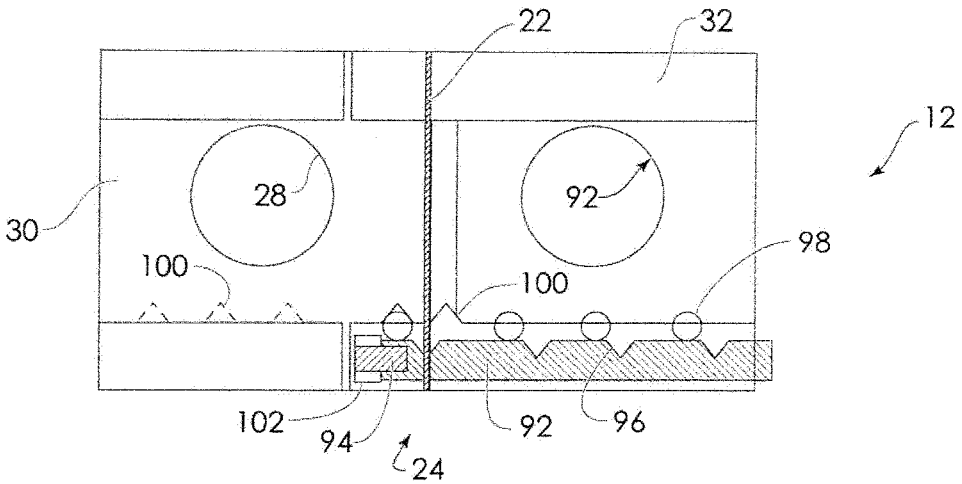
FIGS. 10A through 10G show alternative hinge and closure mechanisms according to alternative embodiments of the present design.
Figure 10B:
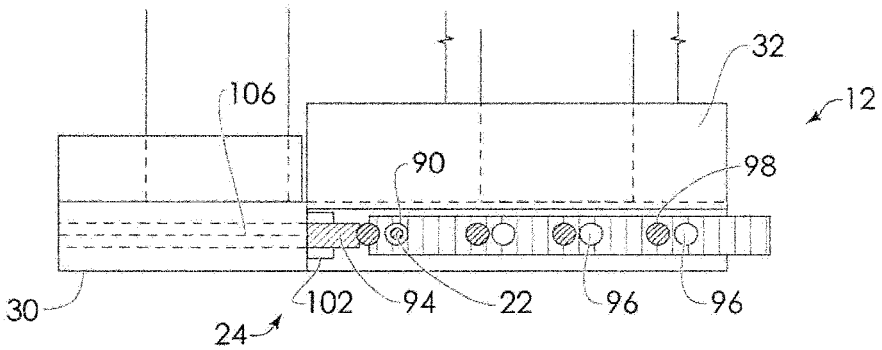
Figure 10C:
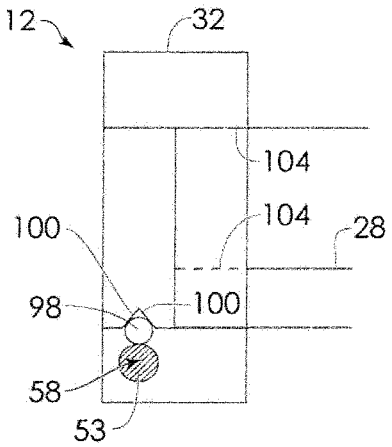

FIGS. 10A through 10C show the device with the buttstock 18 locked into the folded position by the outboard detent ball 90. The plunger rod 92 is spring 94 loaded and has cutouts 96 with ramps that apply upward force to the detent balls 98 until the plunger rod 92 is depressed, at which time it slides toward the hinge 22 exposing the detent balls 98 to cutouts 96 within the plunger rod 92. At this point, the collars 30 and 32 can be rotated about the hinge 22 to fold or unfold the buffer tube 28. When the unit has been rotated 90 degrees +/− about the hinge 22, and the plunger rod 92 is released by the user, the detent balls 98 will be pushed upward by the plunger rod 92 and into cutouts 100 within the first collar 30. Releasing pressure from the plunger rod 92 will cause it to be forced outward by the plunger return spring 94 which will again push the detent balls upward into the cutouts 100 in the first collar 30. Note that the unit could be structured such that the detent balls are contained within the second collar 32 instead of the first collar 30.

When the plunger rod 92 is depressed, the plunger return spring 94 becomes compressed into a recess within the plunger rod 92. The plunger rod 92 slides linearly within the first collar 30 inside a cutout partially depicted for clarity as 102. An alternative version of the plunger rod 92 which could be used, and operates as follows: wherein the rod is still circular, but only has the recesses for the detent balls on top. It may have a folding lever that protruded from the end. When the lever is rotated, it would rotate the plunger rod and either cam the detent balls upward or release them. If desired, this may be linked to the apparatus which retains buffer 14 within the buttstock 18.

Figure 10D:
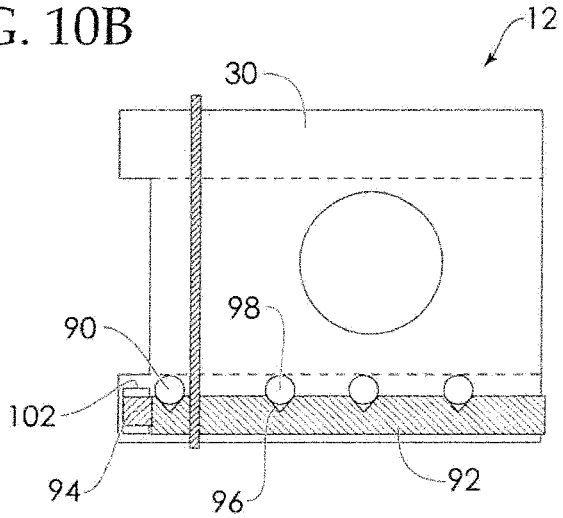
Figure 10E:
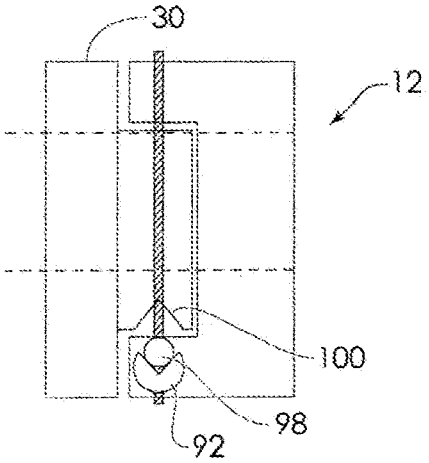
Figure 10F:
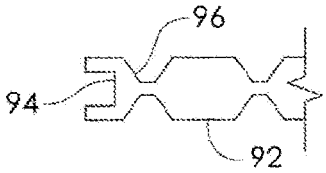
Figure 10G:
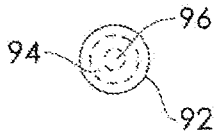

The cutouts 96 within the plunger rod 92 could surround the around the entire circumference of the plunger rod 92, as shown in FIGS. 10F and 10G. The hinge pin 22 penetrates an opening in the plunger rod 92 which is large enough so the hinge pin 22 does not interfere with the movement of the plunger rod 92. Instead of individual cutouts 100 within the first collar 30, a single v-shaped cut could be created along the length of the first collar's 30 hinge block 106 in FIG. 10B. The opening 104 would accommodate movement of the bolt carrier group through the first and second collars 30 and 32, and into the buffer tube 28 if used on an M-16/AR-15 type weapon system.

FIGS. 10D through 10E show the unit with the stock unfolded to the rear. In FIG. 10D, the detent balls 98 are shown being pushed upward into the first collar 30 by the plunger rod 92 which locks the first and second collars 30 and 32 together. In FIG. 10E, the detent balls 98 are shown as being located downward, inside the second collar 32 as if the plunger rod 92 is being depressed. This would free the collars (30 and 32) to rotate about the hinge.

Figure 11A:
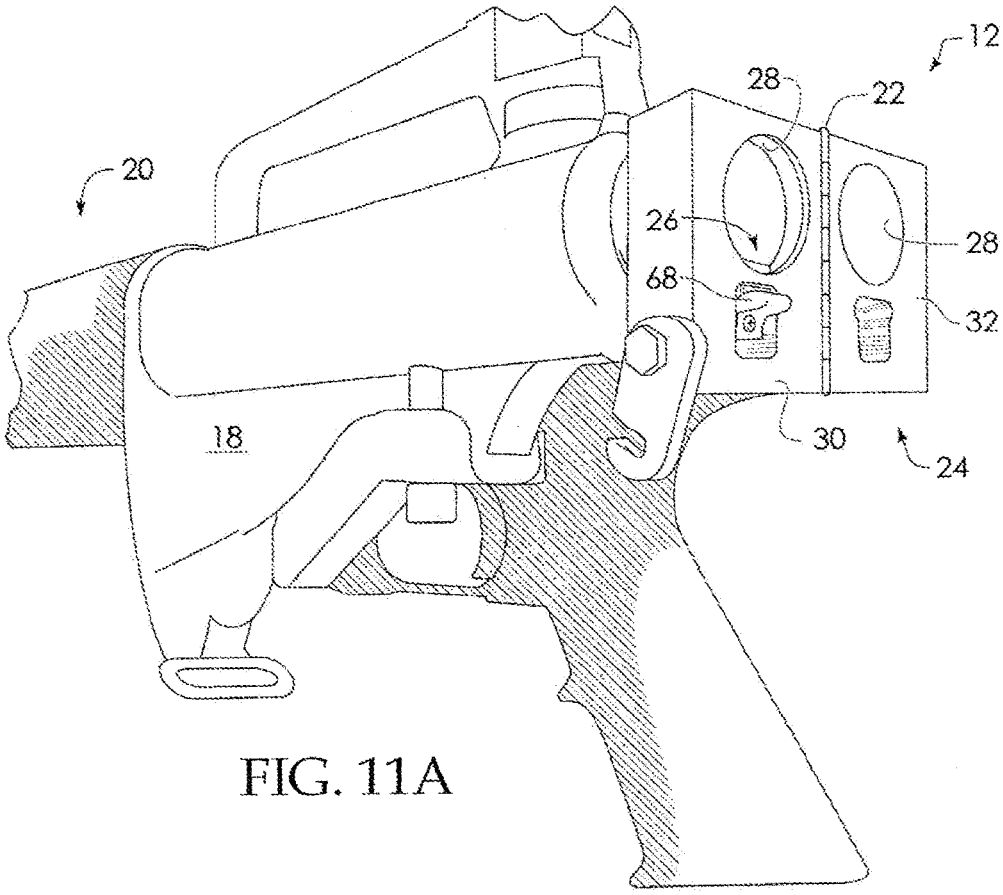
FIG. 11A shows an elevated environmental side view of a folded buttstock disposed on a weapon according to an alternative embodiment of the present design.
Figure 11B:
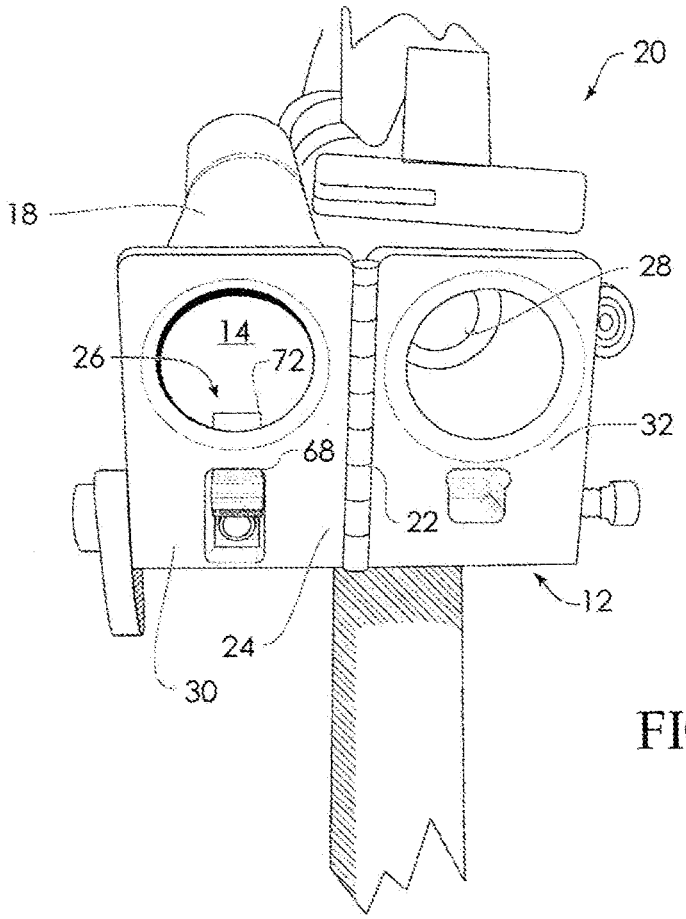
FIG. 11B shows an elevated environmental rear view of a folded buttstock disposed on a weapon according to an alternative embodiment of the present design.
Figure 11C:
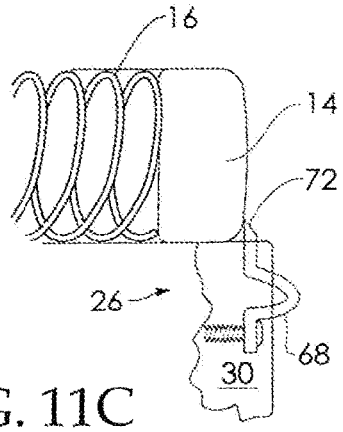
FIGS. 11C and 11D show details of the retainer mechanism 26 in the embodiments of FIGS. 11A and 11B.
Figure 11D:
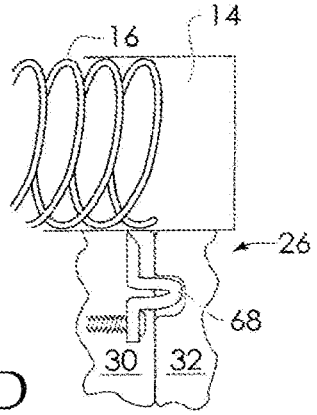

FIGS. 11A and 11B show an environmental view of an example folding stock assembly 12, and a weapon 20 having a folding stock assembly 12 in a folded position. FIGS. 11C and 11D show the operation of the retainer mechanism 26 used in the example of FIGS. 11A and 11B. FIG. 11C shows the retainer mechanism 26 is position to retain the buffer 14 and spring 16.

It is to be understood that the present invention is not limited to the embodiments described above, but encompasses any and all embodiments within the scope of the following claims.

What is claimed is:

1. A buffer tube folding mechanism, comprising:

first and second collars hingedly attached to one another, wherein the first collar is configured to couple to a first buffer tube through a coupling mechanism and the second collar is configured to couple to a second buffer tube through the coupling mechanism, wherein the buffer tube folding mechanism is configured to permit each of the first and second buffer tubes to receive a buffer in a closed position of the buffer tube folding mechanism;

first and second closure mechanisms configured to releasably mate; and a buffer retainer mechanism configured to partially narrow the circumference of the first collar when the first and second collar mechanisms are not mated.

2. The buffer tube folding mechanism of claim 1, wherein the buffer retainer mechanism actuates automatically, or the buffer retainer mechanism is manually actuated.

3. The buffer tube folding mechanism of claim 2, wherein the buffer retainer mechanism operates automatically.

4. The buffer tube folding mechanism of claim 1, wherein the first and second closure mechanisms are manually latched, released, or combinations thereof.

5. The buffer tube folding mechanism of claim 1, in which the first and second collars are configured to overlap in the closed position of the buffer tube folding mechanism.

6. A buffer tube folding mechanism comprising:

first and second collars hingedly attached to one another, wherein the first collar is configured to couple to a first buffer tube through a coupling mechanism and the second collar is configured to couple to a second buffer tube through the coupling mechanism;

first and second closure mechanisms configured to releasably mate; and a buffer retainer mechanism configured to partially narrow the circumference of the first collar when the first and second collar mechanisms are not mated, wherein the buffer retainer mechanism is retracted upon mating the first and second closure mechanisms.

7. The buffer tube folding mechanism of claim 6, in which the first and second collars are configured to overlap when the first and second closure mechanisms are mated.

8. A folding buttstock, comprising:

a buffer tube extending from a first collar and configured to receive a buffer in a closed position of the folding buttstock;

the first collar hingedly attached to a second collar;

first and second closure mechanisms configured to releasably mate;

a buffer retainer mechanism configured to partially narrow the circumference of the first collar; and a mechanism to mate the second collar to a second buffer tube, wherein the second buffer tube is configured to receive the buffer in a folded position of the buttstock and in the closed position of the buttstock.

9. The folding buttstock of claim 8, wherein the buffer retainer mechanism actuates automatically, or the buffer retainer mechanism is manually actuated.

10. The folding buttstock of claim 9, wherein the buffer retainer mechanism operates automatically.

11. The folding buttstock of claim 8, wherein the buffer tube extends from the first collar into a shoulder stock.

12. The folding buttstock of claim 8, in which the first and second collars are configured to overlap in the closed position of the folding buttstock.

13. A folding buttstock, comprising:

a buffer tube extending from a first collar;

the first collar hingedly attached to a second collar;

first and second closure mechanisms configured to releasably mate;

a buffer retainer mechanism configured to partially narrow the circumference of the first collar; and a mechanism to mate the second collar to a second buffer tube, wherein the buffer retainer mechanism is retracted upon mating the first and second closure mechanism.

14. The folding buttstock of claim 13, wherein the first and second closure mechanisms are manually latched, released, or combinations thereof.

15. The folding buttstock of claim 13, in which the first and second collars are configured to overlap when the first and second closure mechanisms are mated.

16. A firearm with a folding buttstock comprising:

a buffer tube extending from a first collar and configured to receive a buffer in a closed position of the buttstock and in a folded position of the buttstock;

the first collar hingedly attached to a second collar;

the second collar being attached to a second buffer tube extending in the firearm (muzzle-ward) forward of the second collar, wherein the second buffer tube is configured to receive the buffer in a closed position of the buttstock;

first and second closure mechanisms configured to releasably mate; and a buffer retainer mechanism configured to partially narrow the circumference of the first collar.

17. The firearm of claim 16, wherein the buffer retainer mechanism actuates automatically, or the buffer retainer mechanism is manually actuated.

18. The firearm of claim 17, wherein the buffer retainer mechanism operates automatically.

19. The firearm of claim 16, wherein the first and second closure mechanisms are manually latched, released, or combinations thereof.

20. The firearm of claim 16, wherein the buffer tube extends from the first collar into a shoulder stock.

21. The firearm of claim 16, in which the first and second collars are configured to overlap when the buttstock is in the closed position.

22. A firearm with a folding buttstock comprising:

a buffer tube extending from a first collar;

the first collar hingedly attached to a second collar;

the second collar being attached to a second buffer tube extending in the firearm (muzzle-ward) forward of the second collar;

first and second closure mechanisms configured to releasably mate; and a buffer retainer mechanism configured to partially narrow the circumference of the first collar, wherein the buffer retainer mechanism is retracted upon mating the first and second closure mechanism.

23. The firearm of claim 22, in which the first and second collars are configured to overlap when the first and second closure mechanisms are mated.

24. A buffer tube folding mechanism comprising:

first and second collars hingedly attached to one another, wherein the first collar is configured to couple to a buffer tube through a coupling mechanism and the second collar is configured to couple to a receiver of a weapon;

a first closure mechanism coupled to the first collar and a second closure mechanism coupled to the second collar, in which the first and second closure mechanisms are configured to releasably mate to position the first and second collars adjacent to each other in a closed position of the first and second closure mechanisms; and a buffer retainer mechanism configured to retain a buffer within the first collar when the first collar is coupled to the buffer tube.

* * * * *